United States Patent [19]

Kubbutat

[11] Patent Number: 5,069,014

[45] Date of Patent: Dec. 3, 1991

[54] HOLDING MEANS FOR SECURING FACADE PANELS

[76] Inventor: Albert Kubbutat, Buhmaystr. 13, D-8886 Wittislingen, Fed. Rep. of Germany

[21] Appl. No.: 460,558

[22] Filed: Jan. 3, 1990

[30] Foreign Application Priority Data

Jan. 9, 1989 [DE] Fed. Rep. of Germany ..... 3900397
Mar. 8, 1989 [DE] Fed. Rep. of Germany ..... 3907510

[51] Int. Cl.[5] ..... E04B 1/38; E04B 2/88; E04B 2/90

[52] U.S. Cl. ..... 52/235; 52/511

[58] Field of Search ..... 411/82, 258, 179, 177, 411/180, 182; 52/612, 311, 316, 144, 145, 235, 506–513, 309.2, 309.9, 511

[56] References Cited

U.S. PATENT DOCUMENTS

| | | | |
|---|---|---|---|
| 1,873,894 | 8/1932 | Kimbell | 411/177 |
| 2,005,895 | 6/1935 | Hengstenberg | 52/513 |
| 2,135,118 | 11/1938 | Stewart | 52/704 |
| 2,365,629 | 12/1944 | Eckel | 52/506 |
| 3,194,708 | 7/1965 | Fourcade et al. | 52/309.9 |
| 4,158,274 | 6/1979 | Saenz | 52/311 |
| 4,793,112 | 12/1988 | Sufke | 52/511 |

FOREIGN PATENT DOCUMENTS

| | | | |
|---|---|---|---|
| 789416 | 8/1935 | France | 52/513 |
| 1578022 | 8/1969 | France | 52/612 |
| 2468700 | 5/1981 | France | 52/144 |

*Primary Examiner*—James L. Ridgill, Jr.
*Attorney, Agent, or Firm*—Fleit, Jacobson, Cohn, Price, Holman & Stern

[57] ABSTRACT

The holding means serves for securing facade panels of stone, ceramic glass, metal sheet or the like, and has at least one screw element projecting transversely from the panel rear side and having a screw thread. To permit a simple accurate assembly as free from joint gaps as possible a support plate attachable by adhesion to the panel rear side is provided in the form of a lightweight component of expanded glass, expanded clay, polystyrene, polyurethane foam material, expanded slate, vermiculite, pressed glass fibres or the like, possibly with addition of binder. Said plate includes glass fabric layers which are preferably fixed to both outer sides and increase the flexural stiffness. Incorporated on one side into the support plate is a holding plate to which a screw element preferably in the form of a threaded bush and extending through the support plate is fixed. An additional mechanical securing which can be subjected to particularly high thermal and mechanical stresses can be provided in the form of a glass solder connection of a carrier plate fixedly incorporated into the support plate at the side facing the facade panel to the adjoining facade panel.

15 Claims, 1 Drawing Sheet

HOLDING MEANS FOR SECURING FACADE PANELS

BACKGROUND OF THE INVENTION

1. Field of the Invention

The invention relates to a holding means for securing facade panels of stone, ceramic, glass, sheet metal or the like comprising at least one screw element which projects transversely from the panel rear side and has a screw thread.

2. Description of the Prior Art

In a known holding means of this type ceramic composite bodies traversed by a stainless steel screw are adhesively bonded to the panel rear side. The end of the stainless steel screw projecting out of the ceramic composite body forms a threaded stud projecting from the panel rear side. Associated with said stud is a self-locking stainless steel nut for fixing the facade panel on a support profile which is mounted on the walls of a building. The ceramic composite bodies used in these holding means permit satisfactory attachment only to specific facade panels. If due to the panel or slab weight and the wind forces to be taken into consideration, relatively large forces are to be expected, a large number of ceramic composite bodies are required which can be placed and fixed accurately only with large spacing and the screwing of which to the support profile sections is correspondingly complicated and time-consuming.

SUMMARY OF THE INVENTION

The invention therefore has as its object the further development of the holding means of the type mentioned at the beginning in such a manner that practically all conceivable materials can be selected for forming the facade panel and nevertheless a simple exact and joint-gap-free assembly is possible and excellent holding is ensured even under extreme force and temperature conditions.

The invention therefore proposes in a holding means for securing facade plates of stone, ceramic, glass, sheet metal or the like and comprising at least one screw element projecting transversely from the panel rear side and having a screw thread the improvement comprising a support plate adapted to the dimensions of the facade panel, fixable by adhesion to the panel rear side and having the form of a lightweight building element of expanded glass, expanded clay, polystyrene, polyurethane molded material, expanded slate, vermiculite, compressed glass fibres or the like, possibly with addition of binder, having a glass fabric layer preferably secured to both outer sides and increasing the flexural stiffness, and at least one holding plate which is incorporated on one side into the support plate and to which the screw element extending through the support plate is fixed.

Said holding means ensures on the one hand a large-area and correspondingly durable connection of the facade panel to the practically incombustible support plate and on the other hand once again a correspondingly stable connection is ensured of the support plate carrying the facade panel and the incorporated screw element.

An embodiment has been found to be particularly favourable in which the screw element passing through the support plate is formed by a threaded bush. On assembly, a threaded bolt can easily be fixed in said threaded bush mounted in the support plate material for establishing a connection to a supporting substructure or an intermediate support element, for example a suspension hook. It should be pointed out here that it is already known to drill into relatively thick facade panels of rock from the rear side thereof blind holes which serve to receive and fix panel dowels or plugs which are provided at their outer side with claw-like peripheral grooves and are formed as threaded bushes for receiving threaded bolts. Because of the direct incorporation of said panel plugs in blind holes of the facade panels the latter must be made particularly thick to ensure adequate blind hole depth and thus panel plug length. However, such a panel thickness gives a considerable panel weight. The panel plugs are subjected to correspondingly high loads and consequently must be able to withstand the stresses resulting therefrom. Such a holding means is thus not suitable for fixing relatively thin and consequently lighter facade panels.

By the incorporation according to the invention of the threaded bush into the support plate material it is on the other hand ensured that facade panel-support plate units thus equipped can be stored closely engaging each other without damaging each other. For there are no metal holding elements of any type which project beyond the outer surfaces.

It has been found very expedient to connect to the one end of the threaded bush an annular disc forming a bush flange. Said annular disc permits in advantageous manner a strong connection of the threaded bush to the holding plate.

With regard to a reliable connection of the threaded bush to the holding plate it has been found very favourable for the holding plate to be provided with a central bore and an impression which is concentric with the central bore and the depth of which corresponds to the thickness of the annular disc forming the bush flange.

Just like the holding plate, the annular disc comes to lie with its outer surface in the same plane and this promotes a strong connection of the support plate together with the holding plate and the annular disc to the rear side of the facade panel.

To enhance the connection of the holding plate to the support plate it has been found advantageous to provide the holding plate with a plurality of projections pressed into the material of the support plate.

The glass fabric layers provided at the holding plate outer side can be fixed to the holding plate using synthetic resin, in particular epoxy resin. However, for the fixing, the use of glass frit powder with a softening or melting point of 600° C., lying below that of normal enamel glass at 700° C. to 750° C., has been found particularly advantageous. In this manner, facade panels can be made and mounted on the building walls which consist of completely incombustible support material and therefore need not be additionally mechanically anchored in accordance with the valid fire prevention regulations for ventilated facades. The metallic brackets provided in practice for this purpose, with which facade panels are frequently held in the region of their edges, may be dispensed with. This makes it possible to place the facade panels so tightly together that practically no visible joints result.

An additional mechanical securing even under extreme force and temperature conditions is ensured in that between the support plate and the facade panel in at least a partial area a mechanical connection is provided in the form of a glass connection of a carrier plate, fixedly incorporated into the support plate at the side facing the facade panel, to said adjoining facade panel.

The holding means thus constructed ensures on the one hand that extremely high wind forces can be taken up. On the other hand, it can also withstand particularly high thermal stresses.

With regard to a particularly economic low-cost assembly, a favourable arrangement is one in which the carrier plate is heatable up to the temperature producing softening of the glass solder via resisting heating wires which lead to said support plate from the side of the carrier plate remote from the facade panel and are incorporated into said carrier plate. The glass solder which is used can be introduced very simply, for example in powder form, into the region between the carrier plate and the facade panel. It has however been found particularly favourable for the support plate to be formed as prefabricated unit provided with a glass coating and possibly resistance heating wire fixed thereto. By supplying current to the resistance heating wires the glass solder can be heated in very simple manner to the soldering temperature, which lies at about 400° to 500° C. As soon as the glass solder has cooled again it represents a reliable incombustible mechanical joint which is particularly effective even at very high temperatures, for example in the event of a fire.

To ensure that the carrier plate is not only satisfactorily connected to the facade panel but also fixedly anchored in the carrier plate, the carrier plate is provided in very advantageous manner with an extension serving to convey the support force into the support plate, said extension projecting transversely from said carrier plate up to the vicinity of the remote side of the support plate. It has been found particularly effective to associate with the carrier plate a counter plate which bears on the opposite side of the support plate, is connectable to the extension and is possibly connected to the carrier plate via a detent connection. This is achieved in very expedient manner in that the extension of the carrier plate has the form of a sleeve into which a bush fixed to the counterplate can be inserted and firmly clipped.

BRIEF DESCRIPTION OF THE DRAWINGS

Further details, advantages and features of the invention will be apparent from the following description and the drawings to which express reference is made with regard to all details not described in the text and in which.

DESCRIPTION OF THE PREFERRED EMBODIMENTS

Figure 1:
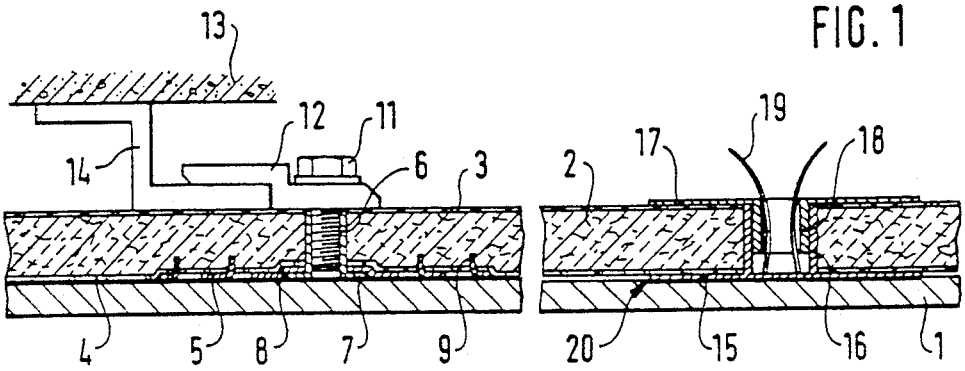
FIG. 1 shows in a position pivoted through 90° a section through a facade panel which is secured at its rear side to a support plate, this being done in the region of a holding means.

As can be seen from FIG. 1 a facade panel 1 of stone, ceramic, glass, sheet metal or the like, is fixed with its rear side on a support plate 2 by adhesion by means of epoxy resin, PU-phenol resin or the like adhesive 21. Said support plate 2 in the form of a lightweight component is formed from expanded glass, expanded clay, expanded slate, vermiculite, pressed glass fibres or the like with addition of an organic or inorganic binder such as epoxy resin, PU phenol resin or the like. To increase the bending stiffness of the support plate 2 glass fabric layers 3, 4 are incorporated into the synthetic resin on both outer sides of said plate.

On the side of the support plate 2 facing the facade panel 1 into said support plate a holding plate 5 is incorporated to which a screw element in the form of a threaded bush 6 extending through the support plate 2 is fixedly connected. The length of the threaded bush 6 is slightly shorter than the thickness of the support plate 2 so that it does not project beyond the surface. The one end of the threaded bush 6 is connected to an annular disc 7 forming a bush flange. The holding plate 5 is provided with a central bore and an impression 8 which is concentric with the central bore and the depth of which corresponds to the thickness of the annular disc 7 forming the bush flange. The annular disc 7 is fixedly connected, for example by welding, to the holding plate 5. The holding plate 5 is provided with a plurality of projections 9 pressed into the material of the support plate 2. These projections are formed by punching out and bending up tongues from the holding plate material.

The holding plate 5 engages with the projections 9 through the glass fabric layer 4 fixed on the outer side of the support plate 2.

As is apparent from FIG. 1, a threaded bolt 11 can be screwed into the threaded bush 6 provided with an internal thread and by means of said bolt on the side of the support plate 2 remote from the facade panel a hook 12 serving for the suspension can be fixed to said plate 2 in the usual manner and engages over a rail 14 mounted on a building wall 13.

The facade panel 1 can be secured with its rear side by means of epoxy resin or the like to the extremely light but very stable support plate 2. If the facade plate consists of glass or of sheet metal with an enamel-glass-like coating, it can be connected to the support plate 2, providing it consists of expanded glass or another inorganic material of low density having a softening or melting point of 700° to 750° C., directly with the aid of glass frit powder of which the softening or melting point of about 600° C. lies beneath that of normal enamel glass. The facade panel-carrier plate unit thus formed and consisting of incombustible material can be mounted practically without joint gaps on a building wall or the like solely by the hooks 12 or the like which are secured by means of the threaded bolt 11 screwed into the threaded bush 6.

Figure 3:
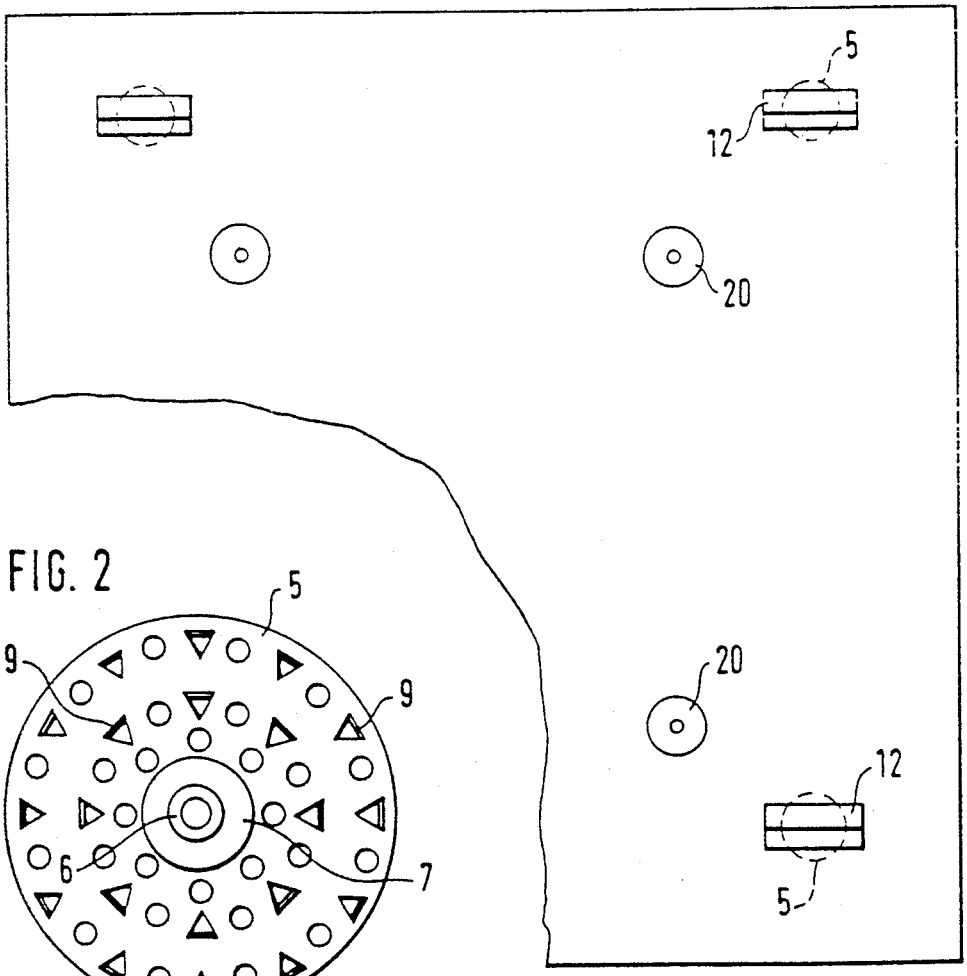
FIG. 3 is a plan view of a support plate to illustrate the distribution of the holding plates and hooks on the one hand and the glass solder joint on the other.
Figure 2:
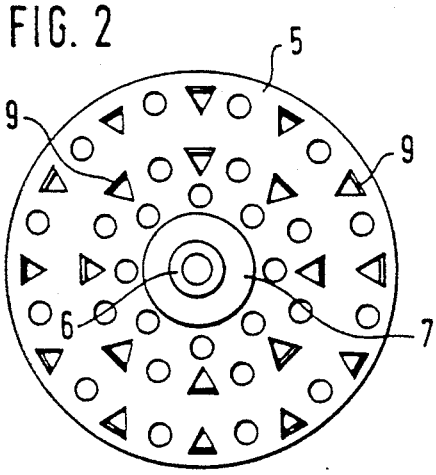
FIG. 2 is a plan view of the holding plates used in the facade panel-support plate unit according to FIG. 1

As apparent from FIG. 1 in conjunction with FIG. 3, when a direct connection of facade panel 1 and support plate 2 by glass solder is not possible the holding means illustrated comprises in the region of the support plate 2 at the side facing the facade panel 1 a fixedly incorporated carrier plate 15 of which the outer surface extends practically flush with that of the support plate 2. Said carrier plate 15 is made round similar to the holding plate 5; it consists preferably of stainless steel. For the fixing thereof with respect to the support plate 2, the carrier plate 15 is provided with an extension in the form of a sleeve 16 which serves to conduct the support forces into the support plate 2, projects transversely thereof and extends up to the vicinity of the remote side of the support plate. On the side of the support plate 2 opposite the carrier plate 15 there is a counter plate 17 to which a bush 18 is fixed. Said bush 18 is adapted to be pushed into and clipped in the sleeve 16. For this purpose, in a manner not shown in detail detent noses are pressed out of the sleeve 16 or the bush 18 in the direction towards the bush 18 and sleeve 16 respectively and in the fixedly clipped state undetachably engage into corresponding recesses of the bush 18 or sleeve 16 respectively.

The ends 19 of a resistance heating wire incorporated in the vicinity of the carrier plate 15 into the support plate 2 are led through the sleeve 16 and the bush 18. With the aid of said resistance heating wire the carrier plate 15 can be heated to a temperature ensuring softening or melting of pulverulent glass solder introduced between carrier plate 15 and facade panel 1. Instead of this a prefabricated unit comprising the carrier plate 15 with a glass coating and possibly resistance heating wire secured thereto may be employed. After the cooling the carrier plate 15 and with it the support plate 2 are fixedly bonded to the facade panel 1 via the glass solder joint thus formed. Expediently, the fixing of the counter plate 17 to the support plate 2 and thus the undetachable connection to the carrier plate 5 does not take place until after forming the glass solder connection.

FIG. 3 shows schematically that besides 4 holding plates 5 and screwed-on hooks 12 arranged at the corners of the support plate 2 four glass solder joints 20 are provided.

With the aid of the holding means described very thin facade panels 1 may be handled, the weight thereof amounting to only a fraction of the weight of conventional facade panels.

In the production of the support plates 2 with low density, high mechanical strength and good vamping properties, for example 70–95 parts by weight open-pore expanded glass beads of the granular fraction 0.2 to 20 mm and a raw density between 0.2 and 0.55 g/cm$^3$ are mixed with 4–30 parts by weight of an epoxy binder. The epoxy binder consists of bisphenol resin with which 0.5–5 parts by weight of a polysiloxane are mixed, and an amine hardener. The inflated glass beads are wetted on their surface. They are filled into a die corresponding to the form of the support plate 2 and heat then supplied, the amine hardener thereby reacting with the polysiloxane and the epoxy resin and an epoxy foam forming between the expanded glass beads.

I claim:

1. A building panel assembly comprising a facade panel, and holding means for securing the facade panel on a building wall, the holding means comprising a support plate of a lightweight building material having a front face secured by adhesive to a rear surface of the facade panel, the support plate including at least one outer layer of glass fabric, at least one holding plate on the front surface of the support plate, and a screw-threaded bushing held by the holding plate, the bushing extending through the support plate and the holding plate having a plurality of protrusions impressed in the support plate.

2. An assembly as claimed in claim 1 wherein the protrusions comprise tongues upset from the holding plate.

3. An assembly as claimed in claim 1 wherein the holding plate is bonded to the support plate with a synthetic resin binder.

4. An assembly as claimed in claim 1 wherein the support plate is bonded to the glass fabric layer with a synthetic resin binder.

5. An assembly as claimed in claim 1 wherein the lightweight building material is selected from a group consisting of expanded glass, expanded clay, polystyrene, polyurethane molded material, expanded slate, vermiculite and compressed glass fibers.

6. An assembly as claimed in claim 1 wherein the bushing has a flange at one end fixed to the holding plate.

7. An assembly as claimed in claim 6 wherein the flange is received in a depression in the holding plate surrounding an aperture through which the bushing extends, the flange being flush with parts of the holding plate surrounding the depression.

8. An assembly as claimed in claim 1 wherein the support plate has a melting temperature of 700° C. to 750° C., the facade panel has a rear surface with an enamel glass-like coating, and the facade panel is bonded to the support plate with a glass frit powder having a melting point of about 600° C.

9. An assembly as defined in claim 8 which includes resistance heating wires extending through the support plate, the heating wires being used for heating the glass solder.

10. An assembly as defined in claim 8 wherein the support plate includes a carrier plate facing the facade panel and bonded thereto with a glass solder connection.

11. An assembly as claimed in claim 10 wherein the carrier plate includes a glass coating.

12. An assembly as claimed in claim 10 wherein the carrier plate has an extension projecting into the support plate for transmitting support forces into the support plate.

13. An assembly as claimed in claim 12 wherein the extension is connected to a counter plate on a rear surface of the support plate.

14. An assembly as claimed in claim 13 wherein the extension comprises a sleeve and resistance heating wires extend through the sleeve, the wires being used for heating the glass solder.

15. An assembly as claimed in claim 14 wherein the sleeve is connected to the counter plate with a detent connection.

* * * * *